US011801404B1

(12) United States Patent
Sabin

(10) Patent No.: US 11,801,404 B1
(45) Date of Patent: Oct. 31, 2023

(54) HEATED AIR N95 MASK, HEATED AIR TRAINING WORKOUT MASK AND MULTI-FUNCTION MASK

(71) Applicant: Robert Sabin, Mill Neck, NY (US)

(72) Inventor: Robert Sabin, Mill Neck, NY (US)

( * ) Notice: Subject to any disclaimer, the term of this patent is extended or adjusted under 35 U.S.C. 154(b) by 0 days.

(21) Appl. No.: 17/885,178

(22) Filed: Aug. 10, 2022

(51) Int. Cl.

| | |
|---|---|
| ***A62B 23/02*** | (2006.01) |
| ***A41D 13/11*** | (2006.01) |
| ***A62B 18/02*** | (2006.01) |
| ***A63B 23/18*** | (2006.01) |

(52) U.S. Cl.
CPC ..... *A62B 23/02* (2013.01); *A41D 13/1138* (2013.01); *A62B 18/025* (2013.01); *A63B 23/18* (2013.01)

(58) Field of Classification Search
CPC ..... A62B 23/02; A62B 18/025; A62B 18/02; A62B 18/04; A62B 18/045; A62B 18/06; A41D 13/1138; A63B 23/18
See application file for complete search history.

(56) References Cited

U.S. PATENT DOCUMENTS 2,199,231 A * 4/1940 Schwartz ..... A62B 18/025 128/206.17
2,435,721 A * 2/1948 Lehmann ..... A62B 18/025 128/206.17
2,534,720 A * 12/1950 Loose ..... A62B 18/00 128/206.17
2,751,904 A * 6/1956 Lewis ..... A62B 18/025 55/491
2,874,693 A * 2/1959 Matheson ..... A62B 18/025 128/206.15
3,467,093 A * 9/1969 Hotz ..... A62B 18/02 128/205.24

(Continued)

FOREIGN PATENT DOCUMENTS

CN 114699718 A * 7/2022
KR 20210027723 A * 3/2021
WO WO-2021125753 A1 * 6/2021 ..... A62B 18/025

OTHER PUBLICATIONS

English translation for KR 20210027723, translated by Espacenet.com, translated on May 5, 2023.*

(Continued)

*Primary Examiner* — Tu A Vo
(74) *Attorney, Agent, or Firm* — Alfred M. Walker

(57) ABSTRACT

A face mask apparatus with N95 filter capability is formed with a breathing chamber that provides adjustable warm and humidified air for inhalation. The breathing chamber heats cold air that is breathed in through the face mask during normal breathing, which is worn over the nose and mouth of a person. A temperature gauge monitors temperature for future adjustment of the amount of heat generating current. The air in the chamber is heated for inhalation by a heating pad. The temperature of the Heating Pad and by extension the warm air generated), is regulated/adjusted by increasing or decreasing the current output settings on a controller connected to the power source. Warm and humidified air is produced. The air intake front end includes one or more slots to accommodate N95 filters, dust and pollutant capturing filters, or exercise air flow barriers therein.

10 Claims, 4 Drawing Sheets

(56) References Cited

U.S. PATENT DOCUMENTS

| | | | | | |
|---|---|---|---|---|---|
| 4,601,287 | A * | 7/1986 | Royce, Jr. | A62B 23/02 | 128/206.23 |
| 4,905,686 | A * | 3/1990 | Adams | A61M 16/1075 | 128/207.12 |
| 5,511,541 | A * | 4/1996 | Dearstine | A62B 9/003 | 128/201.13 |
| 5,848,589 | A * | 12/1998 | Welnetz | A62B 99/00 | 128/205.27 |
| 10,772,371 | B1 * | 9/2020 | Sabin | A42B 1/008 | |
| 10,905,585 | B1 | 2/2021 | Sabin | | |
| 11,096,438 | B1 | 8/2021 | Sabin | | |
| 11,234,861 | B2 | 2/2022 | Sabin | | |
| 2011/0212811 | A1 * | 9/2011 | Rutten | A63B 23/18 | 482/13 |
| 2013/0319420 | A1 * | 12/2013 | Danford | A63B 21/0085 | 128/206.21 |
| 2021/0353972 | A1 * | 11/2021 | Adam | B01D 46/16 | |
| 2021/0353980 | A1 * | 11/2021 | Ong Wern | F16K 15/147 | |
| 2021/0379411 | A1 * | 12/2021 | Daeffler | A62B 23/02 | |

OTHER PUBLICATIONS

English translation for WO 2021125753, machine translated by Search Clarivate Analytics, translated on Aug. 31, 2023.*

English translation for CN 114699718, machine translated by Search Clarivate Analytics, translated on Aug. 31, 2023.*

Omega_Polyimide_Film_Insulated_Flexible_Heater_2022.

Omega_Self-Adhesive_Polyimide_Flexible_Heater_302_degrees_F_Max_2022.

BestReviews; "Best Elevation Training Masks"; https://bestreviews.com/sports-fitness/fitness-equipment/best-elevation-training-masks; updated Nov. 2021; downloaded Jul. 9, 2022.

Dupont; "Kapton® RS for Thin, Flexible, Lightweight Heaters"; Dupont / Electronic Solutions, internet Jul. 12, 2022; https://www.dupont.com/products/kapton-rs.html.

Jisa George, et al.; Physiological Hazard Assessment While Wielding Personal Protective Equipment (PPE) Among Health Care Workers; Cureus, Published Mar. 26, 2022; Cureus 14(3):e3510. DOI 10.7759/cureus.23510.

NEWS18; "Does Wearing a Mask for Prolonged Periods Have Side Effects?"; Lifestyle Desk; last updated May 10, 2022; downloaded Jul. 9, 2022; https://www.news18.com/amp/news/lifestyle/does-wearing-a-mask-for-prolonged-periods-have-side-effects-5140651.html.

Today UIC; "New study reports mask-wearing experiences of adults with asthma"; Today/University of Illinois; Jan. 20, 2022; https://todayuic.edu/new study-reports-mask-wearing-experiences-of-adults-with-asthma.

Sevcan Ipek, et al.; "Is N95 facemask linked to dizziness and headache?" Published online Mar. 1, 2021; International Archives of Occupational and Environmental Health (2021) 94:1627-1636; https://doi.org/10.1007/s00420-021-01665-3.

Damon Ward; "The Best Training Masks to Boost Lung Capacity for Peak Performance"; Sports Illustrated Reviews/ Gym & Fitness Reviews; Last updated Apr. 12, 2022; https://www.si.com/review/training-mask.

Kaylee Yue; "Goal 12, Production and Consumption. The Dark Side of the N95"; Monmouth University School of Education/1st Annual Sustainability Education Week; Winning Essay Grades K-4; www.monmouth.edu.

Omega_POLYIMIDE_FILM_INSULATED_FLEXIBLE_HEATER-KHRA_KHLVA_KHA_Series_omega.com_2022.

www.omega.com_Self-Adhesive_Polyimide_Flexible_Heaters_302_degrees_F_Max_website_7-pages_2022.

* cited by examiner

Fig. 6
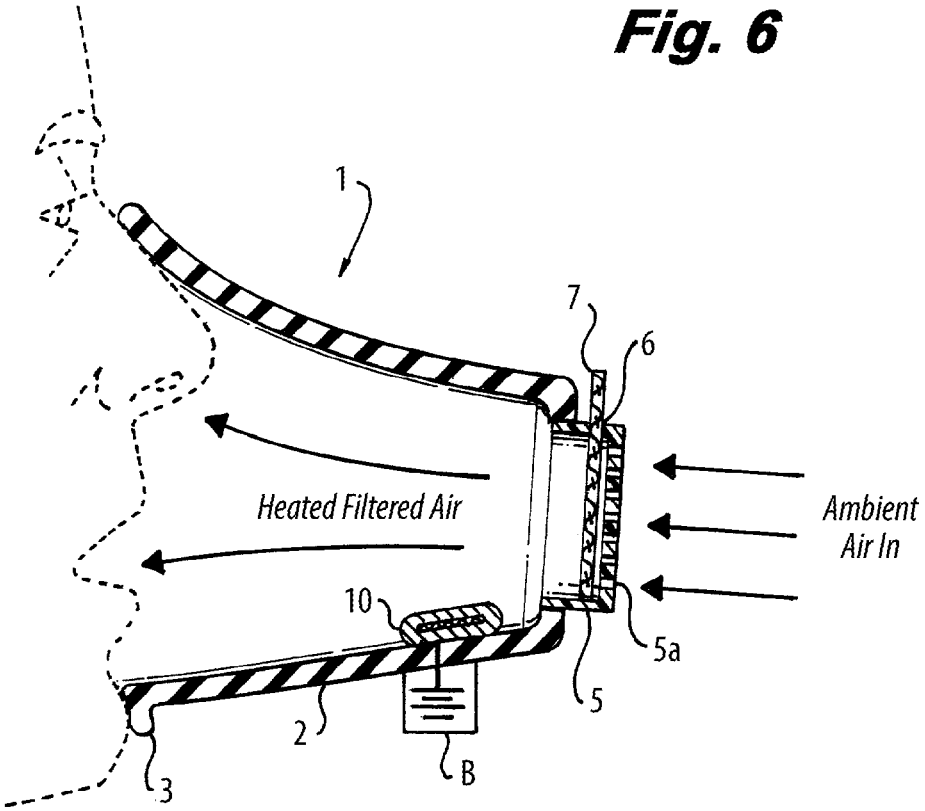
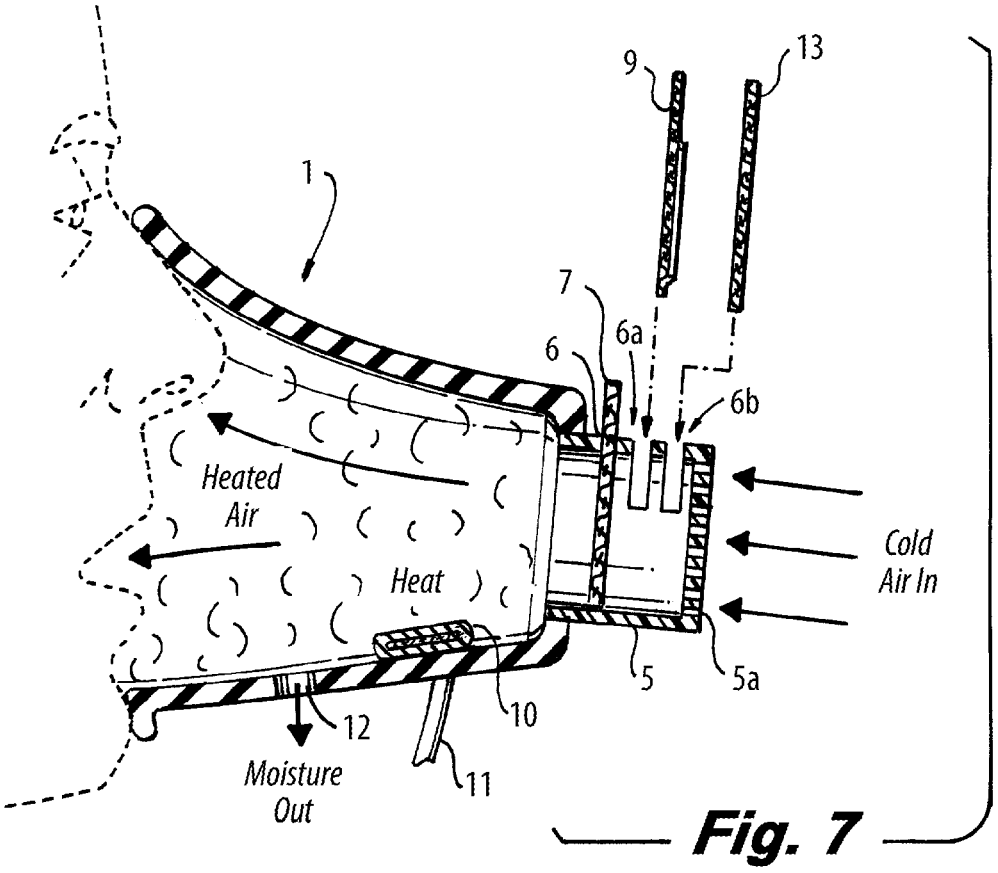
Fig. 7

HEATED AIR N95 MASK, HEATED AIR TRAINING WORKOUT MASK AND MULTI-FUNCTION MASK

FIELD OF THE INVENTION

This invention relates to a face mask and method for using the face mask in all-weather indoor and outdoor conditions, 24 hours a day/7 days a week to condition air drawn into the face mask before it is actually breathed, and thereby supplying warm and humidified air to persons utilizing an N95 mask or other anti-viral mask, and persons utilizing this warm air mask as a training elevation and workout mask. This invention can also be utilized as an N95 mask without heated air, a workout training elevation mask without heat and a fine particulate mask, with and without heated air.

BACKGROUND OF THE INVENTION

All references are submitted and included in their entirety as if reproduced in full herein.

Cold weather heated masks are described in Applicant's U.S. Pat. No. 10,772,371 dated Sep. 15, 2020, and 11,096,438 dated Aug. 24, 2021.

Therapeutic respiratory heated masks are described in Applicant's U.S. Pat. No. 10,905,585 B1 dated Feb. 2, 2021 and 11,234,861 B2 dated Feb. 1, 2022.

There are many publications in the art disclosing the adverse effects of wearing N95 and/or KN95 facemasks to prevent the transmission of Covid 19 and other viral diseases.

These adverse affects are disclosed in a publication by Sevcan Ipek et al, entitled "*Is N95 facemask linked to dizziness and headache?", International Archives of Occupational and Environmental Health* (2021) 94:1627-1636.

Another publication by Jisa George discloses a multitude of adverse health effects from wearing Personal Protective Equipment (PPE), which includes N95 masks, in "*Physiological Hazard Assessment While Wielding Personal Protective Equipment (PPE) Among Health Care Workers*" in Cureus (Mar. 26, 2022) 14(3):e23510.

Another study by Dr. Sharmilee Nyenhuis, in the January 2022 issue of "*The Journal of allergy and clinical immunology*" entitled "*The Mask Use Experience, Covid-19, and Adults with Asthma: A Mixed-Methods Approach*" discloses the severe problems with N95masks with people afflicted with asthma.

Kaylee Yue of Green Brook Middle School, Green Brook, New Jersey, in "*The Dark Side of the N95*"2022, discloses the severe problems with N95 mask pollution from discarded and used masks. Yue references the huge N95 polypropylene pollution from the use of masks.

Applicant lives in the metropolitan New York area and is bombarded and astounded by the N95 mask pollution in parks, parking lots, streets, sidewalks, and all other public places. Polypropylene takes nearly 450 years to decompose. This is a severe problem.

The television News 18 article "*Does Wearing a Mask for Prolonged Periods Have Side Effects?*", discloses a variety of physical and psychological problems that can reduce work efficiency. These include headaches, acne, skin breakdown and end in impaired cognition.

The short comings in the art are that there is a plethora of concerning adverse effects from the use of polypropylene N95 masks. Moreover, the pollution of these used and discarded masks is a huge problem.

Moreover, people with asthma and other respiratory diseases are having greater difficulty with these N95 masks. There are no warm air heated N95 masks that the Applicant has searched for.

Training workout masks are commercially available and popular. It is thought that restricting incoming air through the mask will train a user's respiratory muscles for increased performance. A review of the best training masks by Damon Ward in "*The Best Training Masks to Boost Lung Capacity for Peak Performance*", Sports Illustrated, 12 Apr. 2022, discloses a multitude of training masks commercially available.

Best Reviews in "*Best Elevation Training Masks*", July 2022, discloses considerations for use of training masks.

OBJECTS OF THE INVENTION

The objects, features, and advantages of this invention are to help people and to provide an apparatus to help people disclosed in the Background of the Invention above, in what is thought to be a safe cost-effective manner, with the addition of N95 Covid filtering.

It is further an object of the present invention to provide an ergonomic heated face mask with N95 and other filter capabilities in a relatively shallow nasal/mouth breathing chamber, without awkward and unwieldly protuberance nasal/mouth breathing chambers, and with filtering capabilities.

It is also an object to provide a heated training mask with or without an N95 Covid filter, and a dust carbon filter.

It is also an object of the present invention to provide a heated face mask and method which overcomes the shortcomings of the prior art as explained above.

It is further an object of the invention that Applicant's U.S. Pat. Nos. 10,772,371, 11,096,438, 10,905,585 B1 and 11,234,861 B2 are utilized as a foundation for the present invention.

The objects, features, and advantages of the present invention are to help people and to provide an apparatus disclosed in the background of the invention herein, and as disclosed in the aforementioned two prior patents of applicant for heated masks, in both a safe and cost-effective manner.

Other objects of the invention will become apparent from the following description of the present invention.

SUMMARY OF THE INVENTION

In keeping with these objects and others which may become apparent, the present invention is a heated face mask apparatus (or "face mask with N95 filtering capabilities") that conditions incoming (typically cold or very cold) air, e.g., warms and humidifies air for inhalation, in outdoor and indoor conditions, sleeping or awake, resting or ambulatory Preferably, the all-weather face mask with filtration capability includes:

a) a housing adapted for covering the nose and mouth of a user and forming a nasal/mouth breathing chamber for mingling incoming and exhaled air whereby turbulence of mixed inhaled colder air and exhaled warmer and moister air allows the user to inhale heated and humidified air;

b) the housing having a front opening for allowing entry of inhaled air and exit of exhaled air;

c) a filter container removably attached to the aforementioned housing and covering the front opening;

d) the filter container having a solid perimeter surrounding a grill structure for allowing minimally unrestrictive flow of both incoming and exhaled air; and e) a slotted opening in the solid perimeter to accommodate a removable filter for trapping particulate matter.

The filter has an extension thereof extending out from its perimeter, when deployed in the filter container allowing convenient removal and replacement of the filter. The housing of the face mask preferably comprises a truncated conical shaped body with a face engaging beaded rear edge and a front distal beaded edge.

Preferably, the filter is an N95 polypropylene or similar type filter for trapping virus, bacterial, mold or other environmental contaminant particles.

While not being limited to any particular geometric shape, preferably the front opening of the heated face mask and filter container are geometric in shape, such as for example, circular in configuration. One or more weep holes are provided at the bottom of the breathing chamber of the housing of the heated face mask, for allowing exit of excess moisture within the aforesaid breathing chamber.

Optionally, the perimeter of the filter container is provided with a second slot, or additional slot(s), to accommodate a second filter or a restrictive input exercise barrier for athletes to train running with, so that incoming air is partially limited from entry into the face mask. Optionally, the mask can be a heated restrictive barrier mask.

The breathing chamber of the heated face mask is preferably provided with a separate source of heat for incoming air, which may comprise a heat producing substrate, which is powered by low voltage electricity provided by a battery. The battery is preferably adapted to be worn by the user outside of the heated face mask, such as in an exterior armband worn by the user, or in a pocket of a garment worn by the user, or attached to the heated face mask.

In use, a method of using the wall-weather face mask with filtration capability comprises the steps of:

i) placing the housing over the nose and mouth of a user forming the nasal/mouth breathing chamber for mingling incoming and exhaled air whereby turbulence of mixed inhaled colder air and exhaled warmer and moister air allows the user to inhale heated and humidified air, with the housing having a front opening for allowing entry of inhaled air and exit of exhaled air;

ii) removably attaching the filter container to the housing for covering its front opening, wherein the filter container has a solid perimeter surrounding a grill structure for allowing minimally unrestrictive flow of both incoming and exhaled air;

iii) inserting the filter, such as an N95 or similar type filter for trapping virus, bacterial, mold or other environmental contaminant particles, through one or more slotted openings in the solid perimeter to filter inhaled and exhaled air for trapping particulate matter; and iv) removing and replacing the aforesaid filter by grasping an extension thereof extending out from the perimeter, when deployed in the filter container, thereby allowing convenient removal and replacement of the filter.

The inventive facemask, with N95 and other filter capabilities, is useful for outdoor workers, members of the military, and the like, for example, anyone, of any gender, virtually any age, who would benefit from bespoke warm and humidified air inhalation, hypertension, or coronary heart disease, asthma, for example. In Applicant's face mask, cold air is heated and continuously supplied through in response to the normal breathing process through the heated face mask apparatus, which is worn over the nose and mouth of a person.

The air to be breathed and/or to be exhaled traverses a path through an N95 filter then to the inner volume between a user's mouth and/or nose, and the opening in the breathing chamber, surrounded by the inner surface of the inner frame.

The opening in the breathing chamber is formed to receive a detachable N95 fiber or other filter or barrier, wherein the air to be breathed is drawn through the inlet plate or valve and air to be exhaled is expelled through the inlet plate or valve, and the inlet plate or valve is formed with openings for air passage.

Preferably, the N95 or other filter are detachably connected through slots to the inner frame fixed to the inner surface of the breathing chamber.

Optionally, the breathing chamber is formed with weep holes through which moisture generated as condensation when cold air mixes with moist, warm exhalation air can drain, and optionally, the weep holes are arranged in a bottom of the breathing chamber.

The facial covering and inner frame are optionally manufactured from a material selected from the group of materials consisting of medical grade polyurethane, medical grade neoprene, plastics, medical grade silicone, other silicones, and like materials.

The source of electrical power is preferably a battery in an armband attached via a cable to the facial covering and electrically connected to the conditioning means, wherein preferably the battery, preferably lithium ion, is rechargeable.

Optionally, there is included a solar-based charging system for recharging the battery and/or a filter unit that filters are to be conditioned prior to breathing. Preferably, the charging system is an alternating power generating system, for powering the heated face mask.

The present invention also provides an alternate embodiment for an infinitely adjustable heated training mask.

In keeping with these objects and others that may become apparent, the present invention is a novel modification and improvement of the aforementioned patents.

BRIEF DESCRIPTION OF THE DRAWINGS

The present invention can best be understood in connection with the accompanying drawings. It is noted that the invention is not limited to the precise embodiments shown in the following drawings, in which:

FIG. 6 is a cross sectional view of the mask being worn by the wearer and showing the N95 filter material inserted at the front air intake end of the heated face mask, wherein further the directional arrows show the input flow of ambient air into the mask and the filtered air within the mask. The mask can be heated by a heat generating substrate which is powered by a battery located outside the mask in a pocket or armband of the wearer, or attached to the mask itself, where the battery power is transmitted through a cable, as shown in FIGS. 5 and 7, to the heat generating substrate. Heat generating substrates for heated apparel known as wearables are well known in the art as "heating pads." FIG. 6 also shows the alternate embodiment where the battery for the heat substrate is attached to the outside of the heated face mask.

FIG. 7 is a cross sectional view of the mask being worn by the wearer in a heated condition wherein the directional arrows show cold air streaming into the mask and contacting heat from the heat producing substrate, such as a resistive tape, within the mask, and the heating pad which also heats up the body/frame 2 of the mask it is attached to, as well as an exit aperture for flow of excess moisture in the heated air out of the face mask. FIG. 7 also shows a heating pad which is attached via a cable to a battery located remotely in the wearer's garment pocket or armband (not shown). FIG. 7 also shows an N95 filter inserted within a slot of the of the inlet plate/drop-in filter container. Additionally, FIG. 7 also shows an exercise barrier element in an exploded view above a further slot and the non-N95 dust and particulate filter above yet another slot of the inlet plate/drop-in filter container.

DETAILED DESCRIPTION OF THE INVENTION

Applicant's heated face mask apparatus (or "face mask") 1, which is constructed according to the inventive principles, presents with a similar view in profile to the aforementioned N95 face mask, known in the prior art.

Figure 1:
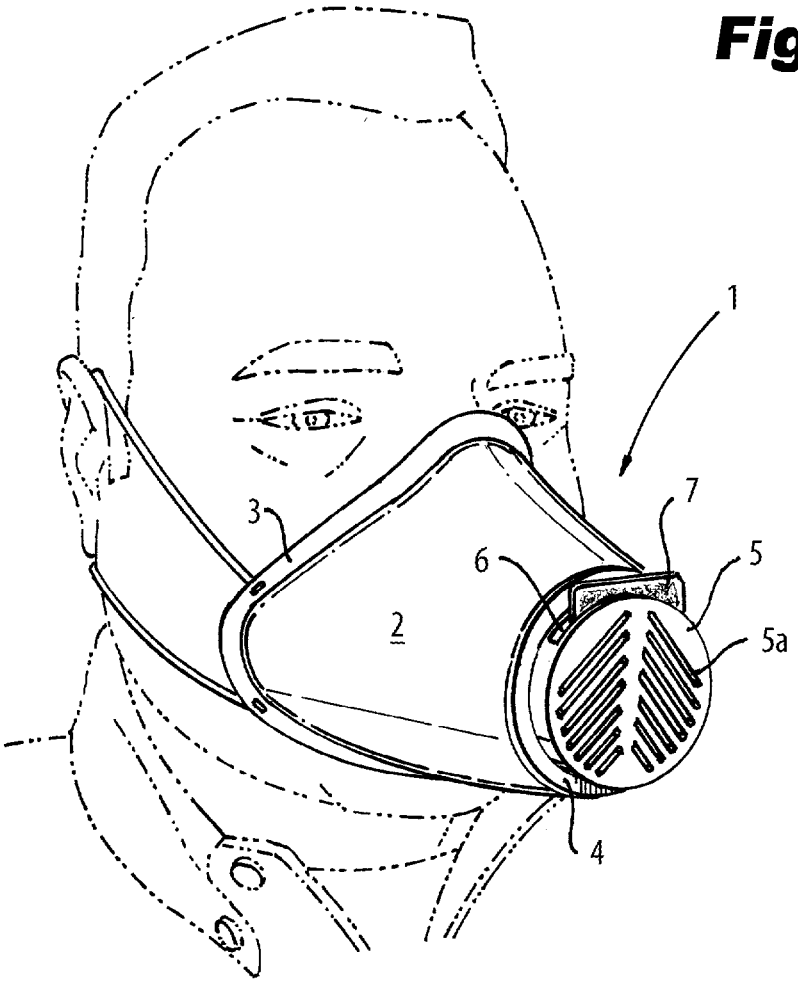
FIG. 1 is a perspective view of a multi-use heated cold weather face mask with N95 capabilities, wherein the wearer of the mask is shown in phantom lines.

FIG. 1 shows a perspective view of a multi-use heated cold weather mask 1 with N95 capabilities, wherein the wearer of the face mask 1 is shown in phantom lines. The face mask 1 preferably has a truncated conical shape body 2, with a face engaging beaded rear edge 3 and a front distal beaded edge 4, having a removable or attached round inlet plate/drop-in filter container 5, with one or more drop-in filter holder respective slots 6 for one or more filters 7, 9 and/or 13, and a grill 5*a* for incoming ambient air to flow through an air intake inlet 8. FIG. 1 also shows the user wearing the face mask 1 with inlet plate/drop-in filter container 5 merged with drop-in filter holder slot 6 and N95 filter 7. The inlet plate/drop-in filter holder 5 is an improvement over prior art inlet plate 5 of the face mask 1 shown in FIG. 3 of Applicant's prior art U.S. Pat. No. 10,772,371BI, which shows inlet plate 5 therein, but without a drop-in filter holder slot 6 for holding an N95 filter 7 within the face mask 1 of FIG. 1 herein.

Figure 2:
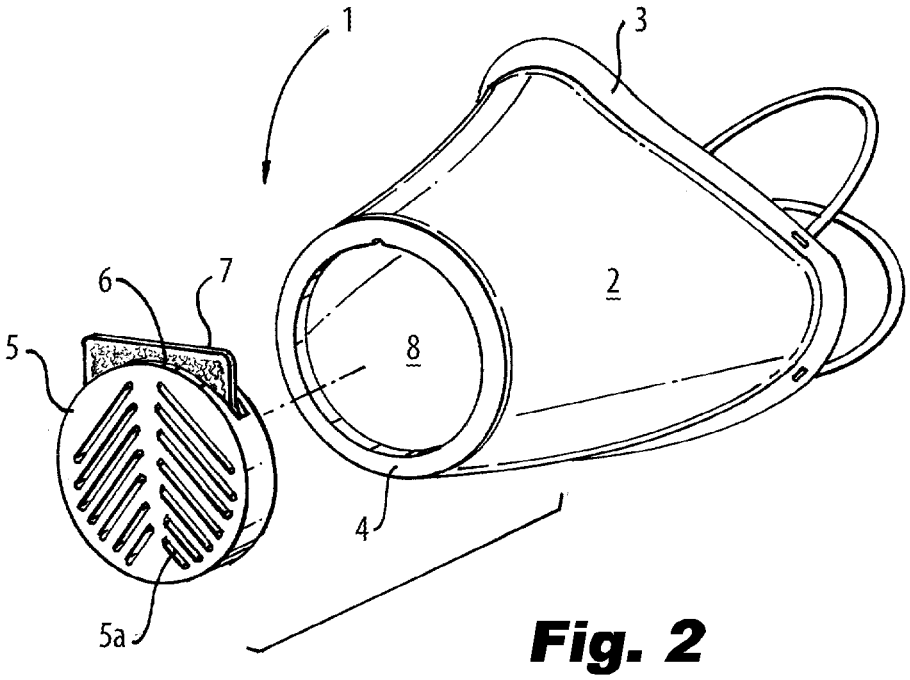
FIG. 2 is an exploded right-side perspective view of the heated face mask of FIG. 1 showing the inlet plate/drop-in filter container spaced apart from an air intake inlet of the mask.

The exploded view of FIG. 2 shows the face mask 1 of FIG. 1, depicting the inlet plate/filter container 5 shown spaced apart from the air intake inlet chamber 8 of the face mask 1. FIG. 2 also shows the face engaging beaded rear edge 3 and the front distal beaded edge 4, having the removable or attached round inlet plate/drop-in filter container 5, with the holder slot 6 for the N95 filter 7 and the grill 5*a* for incoming ambient air to flow through the air intake inlet chamber 8 of face mask 1. The face mask 1 of FIG. 2 is preferably a silicone mask, with the inlet plate/drop-in filter holder container 5 merged together to be inserted In the silicone mask.

Figure 3:
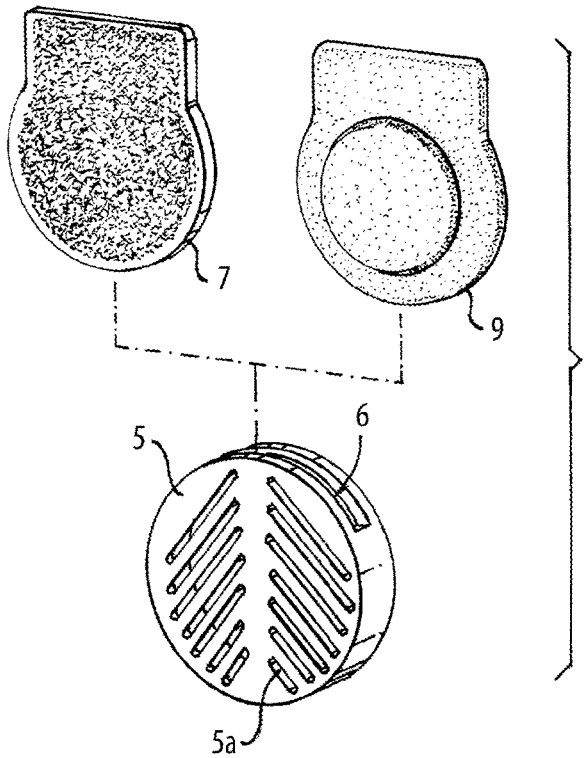
FIG. 3 is a diagrammatic bracketed exploded view of the inlet plate/drop-in filter container of FIGS. 1 and 2 showing an N95 filter material on the left and a restrictive input exercise barrier on the right, wherein the dashed lines indicate that either of the N95 filter material or the restrictive input exercise barrier can be inserted in a top filter holder slot of the inlet plate/drop-in filter container of the heated face mask.

FIG. 3 shows the filter container 5 of FIGS. 1 and 2 with an N95 filter material 7 on the left and a restrictive input exercise barrier 9 on the right, wherein the dashed lines indicate that either of the N95 filter material 7 or the restrictive input exercise barrier 9 can be inserted in a top slot 6 of the air intake inlet plate/drop-in filter container 5.

Figure 4:
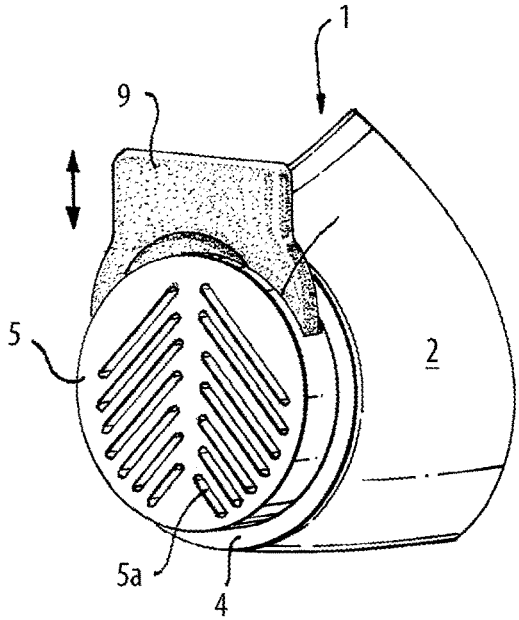
FIG. 4 is a close up detail view of the front input portion of the mask of FIGS. 1 and 2 showing insertion and removal of the restrictive input exercise barrier into a barrier holder slot of inlet plate/drop-in filter container, wherein the directional arrows indicate the insertion or removal thereof.

In contrast with FIG. 2 showing the N95 filter 7 inserted in holder slot 6 of inlet plate/drop-in filter container 5, alternatively FIG. 4 shows the front input portion 4 of the face mask 1 of FIGS. 1 and 2 showing insertion and removal of the restrictive input exercise barrier 9 into slot 6 of inlet plate/drop-in filter container 5, wherein the directional arrows indicate the insertion or removal thereof. It is noted that optionally, there can be a heated respiratory exercise air flow input barrier mask with only a restrictive breathing barrier disk for athletes, who are training in remote wilderness areas without contact with other people, thereby obviating the need for the N95 filter being present with the restrictive breathing barrier disk. Therefore, the heated respiratory exercise air flow input barrier mask can be provided without a slot for an N95 filter material portion.

Figure 5:
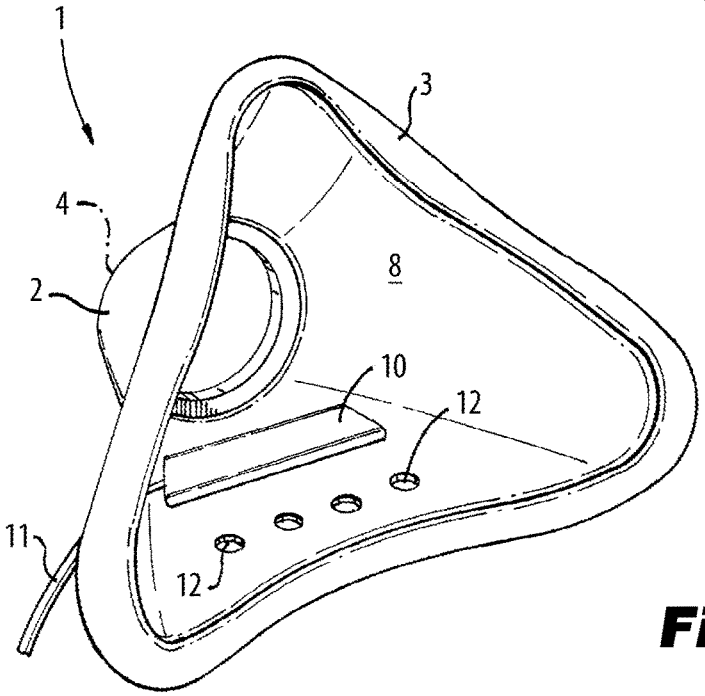
FIG. 5 is an inside out rear view of the heated face mask of FIGS. 1 and 2 showing a heat producing substrate, such as a resistive tape, connected to a heat source (not shown) by the insulated cable wire.

FIG. 5 shows the mask of FIGS. 1 and 2 from the rear, having a heat producing substrate 10 connected to a heat source (not shown) by the insulated cable wire 1, and the exit apparatus' 12, 12, 12, 12 for exit flow of excess moisture from the mask.

FIG. 6 shows from a the side in a cross sectional view of the face mask 1 being worn by the wearer and showing the N95 filter material 7 inserted in the slot 6 of the inlet plate/drop-in filter container 5 located at the front air intake end of the face mask 1, wherein further the directional arrows show the input flow of ambient air into the face mask 1 and the filtered air within the face mask 1. FIG. 6 also shows the alternate embodiment where the battery B for the heat substrate 10 is attached to the outside of 5 the face mask 1, in the vicinity of heat substrate 10 inside of the mask 1.

FIG. 7 also shows from the side in a cross sectional view of the heated face mask 1 being worn by the wearer in a heated condition wherein the directional arrows show cold air streaming into the heated face mask 1 and contacting heat from the heat producing substrate 10, such, for example, a resistive tape, within the heated face mask 1, as well as an exit aperture 12 for flow of excess moisture in the heated air out of the heated face mask 1. An example of a resistive tape 10 can be Kapton® RS of Dupont®. Kapton® is a registered trademark of Dupont Corporation for a polyimide film insulated material, also sold under by Omega.com as in POLYIMIDE FILM INSULATED FLEXIBLE HEATERS, KHRA/KHLVA/KHA series, which are produced in many sizes, including as small as substrate strips having a length of 2 inches (5.08 cm) and a width of 0.5 inches (1.27 cm). FIG. 7 also shows N95 filter 7 inserted within slot 6 of the front filter container and grill 5. Additionally, FIG. 7 also shows the exercise barrier element 9 in an exploded view above slot 6*a* and the non-N95 dust and particulate filter 13 above slot 6*b* of the front of inlet plate/drop-in filter container 5. FIG. 7 also shows a heat substrate 10 which is attached via a cable 11 to a battery located remotely in the wearer's garment pocket or armband (not shown). However, as also shown in FIG. 6, the battery B can be optionally attached to the mask 1 on the outside of the mask 1, in the vicinity of the heating pad/substrate 10 inside of the mask 1.

Figure 8:
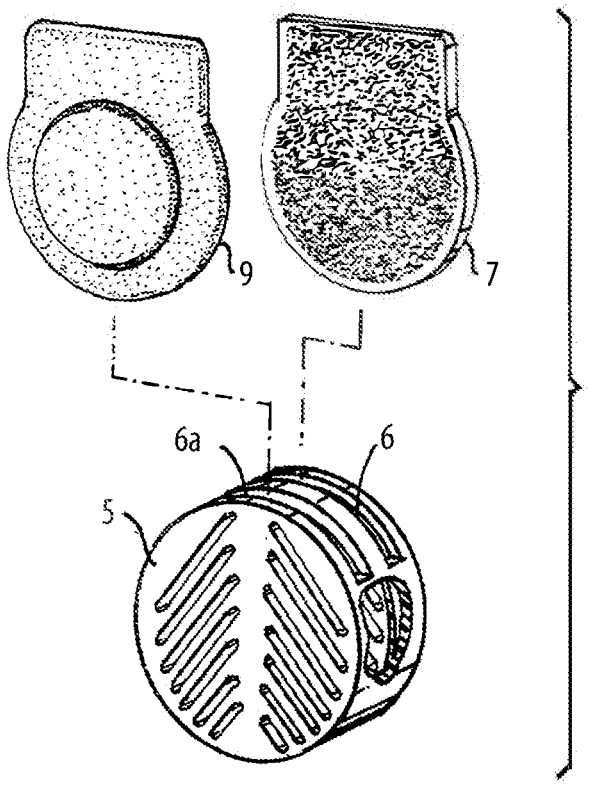
FIG. 8 is a diagrammatic exploded perspective view of an alternate embodiment for the front plate/inlet filter container, wherein a large insertion slot is provided in the front plate/inlet filter container to simultaneously accommodate both an N95 filter and a restrictive input exercise barrier therein.

The diagrammatic view of FIG. 8 shows an alternate embodiment wherein separate large insertion slots 6, 6*a* are provided in the inlet plate/drop-in filter container 5 to simultaneously accommodate both the N95 filter 7 and the restrictive input exercise barrier 9 therein. Although the positioning each filter 7 or exercise barrier 9 is interchangeable, preferably the N95 filter 7 is positioned in slot 6 closest to the mouth of the user. Using the workout, training, elevation mode with a solid filter/exercise barrier disc 9, the quantity of air inspired is regulated by moving the solid disc 9 up and down in the drop-in filter slot, in a guillotine- like motion.

Figure 9:
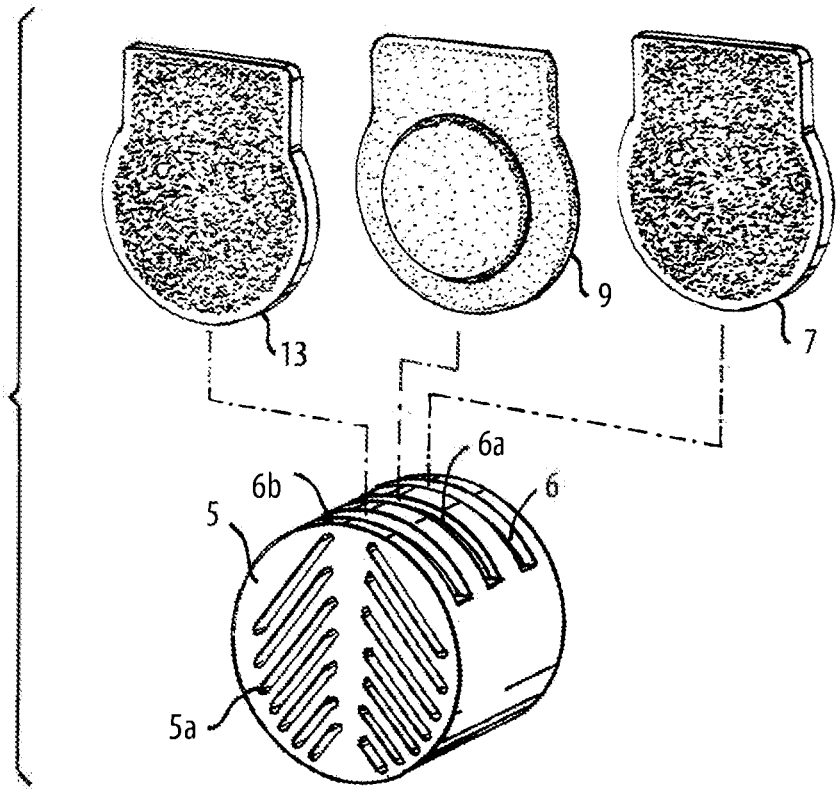
FIG. 9 is a diagrammatic exploded perspective view of the second alternate embodiment wherein separate insertion holder slots are provided in the front plate/inlet filter container for simultaneous use of one or more of each of an N95 filter, a dust and pollutant filter, and a restrictive input exercise barrier.

The diagrammatic view of the FIG. 9 shows a second alternate embodiment wherein three or more separate slots 6, 6*a* and 6*b*, in the inlet plate/drop-in filter container 5 are provided for simultaneous use of each of the N95 filter 7, the restrictive input exercise barrier 9 or conventional dust and pollutants capture filter 13. Although the positioning each filter 7, barrier 9 or filter 13 is interchangeable, preferably the N95 filter is positioned in slot 6 closest to the mouth of the user. Similar to FIG. 8, in FIG. 9, using the workout, training, elevation mode with a solid filter/exercise barrier disc 9, the quantity of air inspired is regulated by moving the solid disc 9 up and down in the drop-in filter slot, in a guillotine- like motion.

The heated cold weather face mask 1 with N95 capabilities for conditioning air to be breathed includes the truncated conical facial covering housing 2 adapted for covering the nose and mouth of a user, wherein the housing body 2 having a front opening 4 with the inlet plate/drop-in filter container 5, which is removably fitted into the front opening of heated face mask 1 having openings for incoming and exhaled air.

The heated face mask 1 has a conditioning means within a minimally restrictive breathing chamber 2 for heating mingled incoming and exhaled air, whereby turbulence of mixed inhaled colder air and exhaled warmer and moister air allows a user to inhale heated and humidified air. The conditioning means has a conductive resistive material 10, such as resistive tape, arranged in the minimally restrictive breathing chamber 2 where the air to be breathed is drawn and air to be exhaled is expelled, to condition and heat air drawn into the minimally restrictive breathing chamber 2 of the heated face mask 1.

Inspired unrestricted and unimpeded cold air is heated in the minimally restrictive breathing chamber 2 of heated face mask 1, and goes directly in the mouth and nose of the user.

Placement and location of the heating pad 10 is within the minimally restrictive breathing chamber of face mask 1 and is connected by a cable 11 to a source of energy for the heating of the coming inhaled air, such as a low voltage battery located in an armband or pocket of a garment worn by the user.

The heating means 10 comprises a strip of heat generating material extending within the minimally restrictive breathing chamber 2, for radiating heat inwardly.

The strip of heat generating material is a preferably carbon fiber tape or the well-known Kapton flexible heaters. An example of a heating pad is the well-known Kapton flexible heaters, for wearables well known in the art, or other conductive material, such as copper or other metals, and the heat energy is electricity.

The heated face mask 1 has optionally at least one support bar to support the carbon fiber tape 10 within said breathing chamber 2 for improving heat transfer.

Cold air taken into the breathing chamber 2 of the mask 1 from the outside meets the warm, moisture-laden air exhaled by the user into the inner air volume of the breathing chamber 2 of heated face mask 1. Weep hole(s) 12 control(s) moisture content of the air to be breathed. The inner frame 2, or breathing chamber structural housing, is preferably manufactured out of medical grade silicone, but optionally may be made of polyurethane, medical grade neoprene®, or other medical grade polymers, such as medical grade polyurethane or medical grade Neoprene®. The material comprising the inner frame 2 may be the same material as the facial covering or a combination of the disclosed materials. The material comprising the facial covering 2 may be any material, such as natural and man-made cloths, leather, processed paper, etc., as known to one of ordinary skill in the art, for making medical and non-medical face masks. The heated face mask 1 includes a relatively shallow nasal/mouth breathing chamber 2, without awkward and unwieldly protuberance nasal/mouth breathing chambers.

Without being limited, held, or bound to any particular theory or mechanism of action of the invention, it is thought that the electric current supplied to the carbon fiber tape or other heating pads or tapes 10, heats the lightweight resistive tape 10. The resistive tape 10 heats the air within the breathing chamber 2 of the heated face mask 1 and also heats the body of the face mask 1. When a person inhales the cold or cool air is heated and humidified in the breathing chamber 2 by the turbulence of the mixing of hot and cold air, then the warm and humidified air is inhaled fully to the lungs. The nose and passages there are also warmed and humidified.

The electrically resistive carbon fiber tape, or heating pad 10 used is a resistive material which, when a current is applied, generates heat. FIG. 5 shows the installation of the resistive carbon fiber tape or heating pad 10 in the mask 1. The carbon fiber tape or heating pad 10 is affixed to the interior (e.g., inner surface) of the inner frame 2 with self-adhesive silicone, epoxy, or other adhesive agents. As shown in FIG. 5, wires affixed to the carbon fiber tape 10 preferably on opposite sides of the tape 10, extend from within the breathing chamber 2 (defined by the contour of inner frame 2 when its proximal edges contact the person's face/head) to outside the inner frame 2, to an electric energy supply, such as lithium ion 7.4V battery, lithium ion 5V battery, lithium ion 3.7V battery, or any known battery with sufficient current to warm the heating pad member 10, or to a solar cell with an attached battery (not shown).

There are other resistive materials which can be used, which, when a current is applied thereto, generate heat. This includes the metals copper, silver, alloys, resistive conductive Fabric, See prior art Econ Tex®, and many more. See Applicant's prior patents (U.S. Pat. Nos.: 10,772,371, 11,096,438, 10,905,585 B1 and 11,234,861 B2).

It is possible to monitor and adjust the breathing chamber temperature of the face mask 1 with a smart phone, or remote computer, and adjust the current output of the battery with a smart phone or computer. To do so, an arm band connected by a cable 11 to the face mask 1 optionally includes a controller and a means for communicating between the controller in the face mask and the smart phone, so that the controller can transmit and receive instructions required to control the temperature and/or humidity in the chamber 2 of the face mask 1. Optionally, a manual controller, which is well known in the art, may be attached to the face mask and have multiple heat/temperature settings.

CONCLUSION

In summary, existing N95 masks utilize the entire surface area of the mask to inspire and expire air. This causes difficulty in breathing as the force of inspiration is dispersed over the entire mask area. Applicant's invention focuses inspiration and expiration of air in about a 1.5 inch center spot, with the balance of the mask impervious silicone. Thus, it follows from the Applicant's tests on himself that his face mask 1 is easier for breathing. Moreover, upon information and belief, there are no combination warm air N95 masks disclosed in the art so far as applicant can tell.

Warm air is much easier and healthier to breathe than colder air, so the invention will be especially helpful to those with respiratory problems, but who also wish to wear a N95 mask.

The applicant measured the quantity of N95 polypropylene used in conventional N95 masks against the quantity of N95 polypropylene used in the Applicant's invention and determined the applicant uses about 10-15% as much N95 polypropylene in the Applicant's N95 filter with a diameter of about 1.3 inches, as against a conventional N95 mask which is entirely made out of N95 polypropylene. Then it follows that Applicant's face mask reduces N95 polypropylene pollution by 85-90%.

Furthermore, upon information and belief, Applicant's heated air training face mask iteration is the only warm air, training, workout mask. This affords the user flexibility of when and where to workout in all seasons.

The Applicant's N95 face mask invention may be used as a straight N95 mask by inserting the N95 filter disc 7 in the filter holder 6 in a few seconds and then it is finished. To heat, the user presses a button to activate the heater substrate 10, which results quickly into a warm air N95 face mask 1.

The Applicant's invention may be used as a straight exercise training mask by inserting the plastic exercise barrier disc 9 in the drop-in filter holder 6*a*, in a guillotine fit, to increase or decrease air inspiration by raising or lowering the exercise barrier disc 9, with or without an N95 filter 7. An N95 filter 7 may also be optionally used with the exercise barrier plastic disc 9 to provide a N95 capable exercise training mask. Preferably, the N95 filter 7 fits in first closest to the mouth, followed by the exercise barrier plastic disc 9. Additionally, a dust or other particulate filter 13 may be used by both the warm air N95 mask and the warm air N95 training mask and both the ambient air face mask 1 and the ambient air exercise barrier training face mask 1 may be used to trap larger dust particles and other airborne particulates.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

What is claimed is:

1. A respiratory exercise training mask with N95 particulate filtration capability comprising:

a housing adapted for covering the nose and mouth of a user and forming a nasal and mouth breathing chamber for mingling incoming and exhaled air whereby turbulence of mixed inhaled colder air and exhaled warmer and moister air allows said user to inhale heated and humidified air;

said housing having a front opening for allowing entry of inhaled air and exit of exhaled air;

a removable N95 particulate filter;

a solid removable respiratory air flow exercise input barrier disk;

a filter container removably attached to said housing and covering said front opening;

said filter container having a solid perimeter surrounding a grill structure formed on a front face of the filter container for allowing minimally unrestrictive flow of both incoming and exhaled air;

at least one first slotted opening in said solid perimeter configured to accommodate the removable N95 particulate filter for trapping particulates, virus, bacterial, mold or environmental contaminant particles, the at least one first slotted opening is formed on a side wall of the filter container; and, a second slotted opening in said solid perimeter configured to accommodate the solid removable respiratory air flow exercise input barrier disk for regulating a quantity of air inspired by being movable in said second slotted opening, the second slotted opening is formed on the side wall of the filter container, whereby the solid removable respiratory air flow exercise input barrier disk is configured to be slidably inserted through and removed from the second slotted opening.

2. The respiratory exercise training air flow input barrier mask of claim 1 in which said breathing chamber is provided with a source of heat for incoming air.

3. The respiratory exercise training air flow input barrier mask of claim 2 in which said source of heat is a heat producing substrate.

4. The respiratory exercise training air flow input bather mask of claim 3 in which said substrate is powered by electricity provided by a battery.

5. The respiratory exercise training air flow input barrier mask of claim 4 in which said battery is configured to be worn by said user outside of or attached to said face mask.

6. The respiratory exercise air flow input barrier mask as in claim 1 is having a plurality of openings for insertion of said N95 particulate filter and a second filter in separate openings of said plurality of openings.

7. A heated respiratory exercise air flow input barrier mask comprising:

a housing adapted for covering the nose and mouth of a user and forming a nasal and mouth breathing chamber for mingling incoming and exhaled air whereby turbulence of mixed inhaled colder air and exhaled warmer and moister air allows said user to inhale heated and humidified air;

said housing having a front opening for allowing entry of inhaled air and exit of exhaled air;

a container removably attached to said housing and covering said front opening;

said container having a solid perimeter surrounding a grill structure formed on a front face of the container for allowing minimally unrestrictive flow of both incoming and exhaled air;

a solid removable respiratory air flow exercise input barrier disk;

a slotted opening in said solid perimeter configured to accommodate the solid removable respiratory air flow exercise input barrier disk for regulating a quantity of air inspired by being movable in said slotted opening, the solid removable respiratory air flow exercise input barrier disk is configured to be slidably inserted through and removed from the slotted opening, the slotted opening is configured to slidably accommodate a removable filter material when the solid removable respiratory air flow exercise input barrier disk is not inserted in the slotted opening, the removable filter material is configured to be inserted through and removed from the slotted opening, wherein the slotted opening is configured to only accommodate one of the removable filter material or the solid removable respiratory air flow exercise input barrier disk at a given time;

wherein said breathing chamber is provided with a source of heat for incoming air.

8. The heated respiratory exercise air flow input barrier mask of claim 7 in which said source of heat is a heat producing substrate.

9. The heated respiratory exercise air flow input barrier mask of claim 8 in which said substrate is powered by electricity provided by a battery.

10. The heated respiratory exercise air flow input barrier mask of claim 9 in which said battery is configured to be worn by said user outside of said face mask or attached to said face mask.

* * * * *